US007540810B2

(12) United States Patent
Hettinger et al.

(10) Patent No.: US 7,540,810 B2
(45) **Date of Patent: *Jun. 2, 2009**

(54) PUTTERHEAD WITH DUAL MILLED FACE PATTERN

(75) Inventors: Ronald K. Hettinger, Oceanside, CA (US); Wayne H. Byrne, Murrieta, CA (US); Lionel Poincenot, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/273,301

(22) Filed: Nov. 18, 2008

(65) Prior Publication Data

US 2009/0069107 A1 Mar. 12, 2009

Related U.S. Application Data

(63) Continuation of application No. 11/532,820, filed on Sep. 18, 2006, now Pat. No. 7,452,283.

(51) Int. Cl.
*A63B 53/04* (2006.01)

(52) U.S. Cl. ..... 473/331; 473/334; 473/340; 473/349

(58) Field of Classification Search ..... 473/324–350; D21/736–746, 750
See application file for complete search history.

(56) References Cited

U.S. PATENT DOCUMENTS

| | | | | |
|---|---|---|---|---|
| D63,284 | S | 11/1923 | Challis | |
| 1,485,272 | A | 2/1924 | Kinsman | |
| 1,526,951 | A | 2/1925 | Beaumont | |
| 1,965,954 | A * | 7/1934 | Davis | 473/242 |
| 2,447,967 | A | 8/1948 | Stone | |
| 3,333,854 | A | 8/1967 | White | |
| 3,343,839 | A | 9/1967 | Borah | |
| 3,708,172 | A | 1/1973 | Rango | |
| 3,779,398 | A | 12/1973 | Hunter | |
| 3,841,640 | A | 10/1974 | Gaulocher | |
| 3,884,477 | A | 5/1975 | Bianco | |
| 3,918,720 | A | 11/1975 | Gordos | |
| 3,937,474 | A | 2/1976 | Jepson et al. | |
| 3,975,023 | A | 8/1976 | Inamori | |
| 3,989,248 | A | 11/1976 | Campau | |
| D245,437 | S | 8/1977 | Thiel | |
| 4,121,832 | A | 10/1978 | Ebbing | |
| 4,252,262 | A | 2/1981 | Igarashi | |
| 4,278,254 | A | 7/1981 | Simjian | |
| 4,326,716 | A | 4/1982 | Lacoste | |
| 4,411,431 | A | 10/1983 | Judice | |
| 4,422,638 | A | 12/1983 | Tucker | |
| 4,688,798 | A | 8/1987 | Pelz | |
| 4,693,478 | A | 9/1987 | Long | |
| 4,754,976 | A | 7/1988 | Pelz | |

(Continued)

*Primary Examiner*—Sebastiano Passaniti
(74) *Attorney, Agent, or Firm*—Michael A. Catania; Elaine H. Lo

(57) ABSTRACT

A putter-head (20) with a main body (22) having a striking face (24), a weight body (25) and an isolation layer 27 is disclosed herein. The striking face (24) has a dual milled pattern thereon. Preferably, a central area (40) has a first milled pattern and a periphery region (42) has a second milled pattern. The main body (22) is composed of a metal material, preferably a stainless steel material.

12 Claims, 11 Drawing Sheets

U.S. PATENT DOCUMENTS 4,792,140 A 12/1988 Yamaguchi et al.
4,811,950 A 3/1989 Kobayashi
4,884,812 A 12/1989 Nagasaki et al.
4,964,641 A * 10/1990 Miesch et al. ..... 473/330
5,046,740 A 9/1991 D'Eath
5,078,398 A 1/1992 Reed et al.
5,083,778 A 1/1992 Douglass
5,178,392 A 1/1993 Santioni
5,299,807 A 4/1994 Hutin
5,301,941 A 4/1994 Allen
5,303,922 A 4/1994 Lo
5,346,216 A 9/1994 Aizawa
5,358,249 A 10/1994 Mendralla
5,405,136 A 4/1995 Hardman
5,405,137 A 4/1995 Vincent et al.
5,417,419 A 5/1995 Anderson et al.
5,437,088 A * 8/1995 Igarashi ..... 29/527.6
5,447,311 A 9/1995 Viollaz et al.
5,458,332 A 10/1995 Fisher
5,460,377 A 10/1995 Schmidt et al.
5,464,212 A 11/1995 Cook
5,465,968 A 11/1995 Aizawa
5,482,281 A 1/1996 Anderson
5,485,997 A 1/1996 Schmidt et al.
5,524,331 A 6/1996 Pond
5,542,675 A 8/1996 Micciche et al.
5,575,472 A 11/1996 Magerman et al.
5,605,510 A 2/1997 Schmidt et al.
5,628,694 A 5/1997 O'Connor, Jr.
5,637,044 A * 6/1997 Swash ..... 473/331
5,674,132 A 10/1997 Fisher
5,685,784 A 11/1997 Butler
5,688,186 A 11/1997 Michaels et al.
5,690,562 A 11/1997 Sturm
D389,208 S 1/1998 Phillips
5,713,800 A 2/1998 Su
5,743,813 A 4/1998 Chen et al.
D395,692 S 6/1998 Butler
5,766,093 A 6/1998 Rohrer
5,766,094 A 6/1998 Mahaffey et al.
5,769,736 A 6/1998 Sato
5,816,936 A 10/1998 Aizawa et al.
5,830,078 A 11/1998 McMahan
5,842,935 A 12/1998 Nelson
D408,881 S 4/1999 Solheim et al.
5,921,871 A 7/1999 Fisher
5,924,939 A 7/1999 Grace et al.
5,931,743 A 8/1999 Baker et al.
5,944,619 A 8/1999 Cameron
5,951,412 A 9/1999 Rose et al.
6,095,931 A 8/2000 Hettinger et al.
6,224,497 B1 5/2001 Antonious
6,273,831 B1 8/2001 Dewanjee
6,309,310 B1 10/2001 Shira
6,328,661 B1 12/2001 Helmstetter et al.
D457,586 S 5/2002 Tang
D458,656 S 6/2002 Tang
6,471,600 B2 * 10/2002 Tang et al. ..... 473/242
6,749,523 B1 6/2004 Forzano
7,004,853 B2 2/2006 Deshmukh
7,166,039 B2 1/2007 Hettinger et al.
7,338,388 B2 * 3/2008 Schweigert et al. ..... 473/342
7,452,283 B2 * 11/2008 Hettinger et al. ..... 473/249
2002/0025855 A1 * 2/2002 Sosin ..... 473/297
2007/0243950 A1 * 10/2007 Billings ..... 473/340

* cited by examiner

FIG. 5
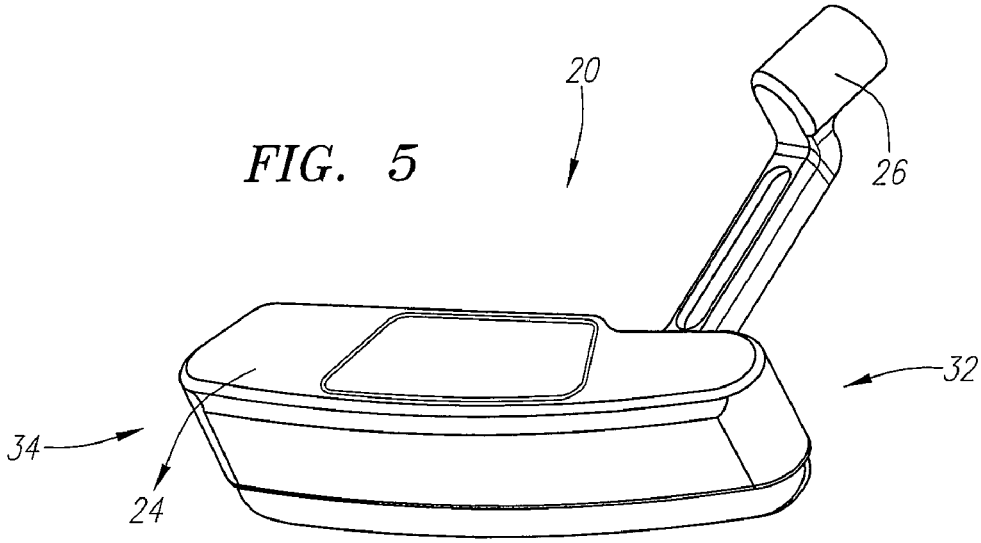
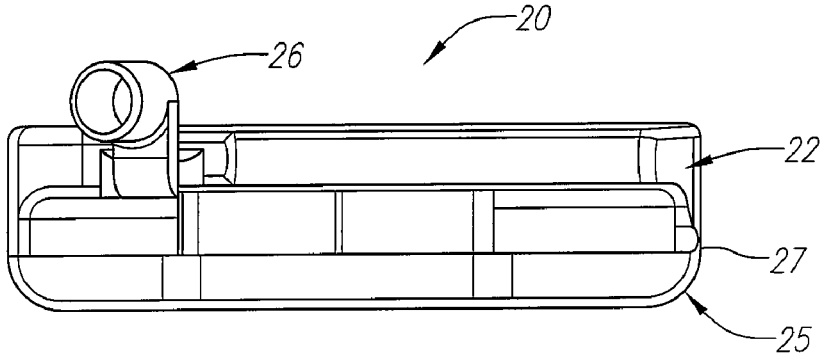
FIG. 5A
FIG. 5B
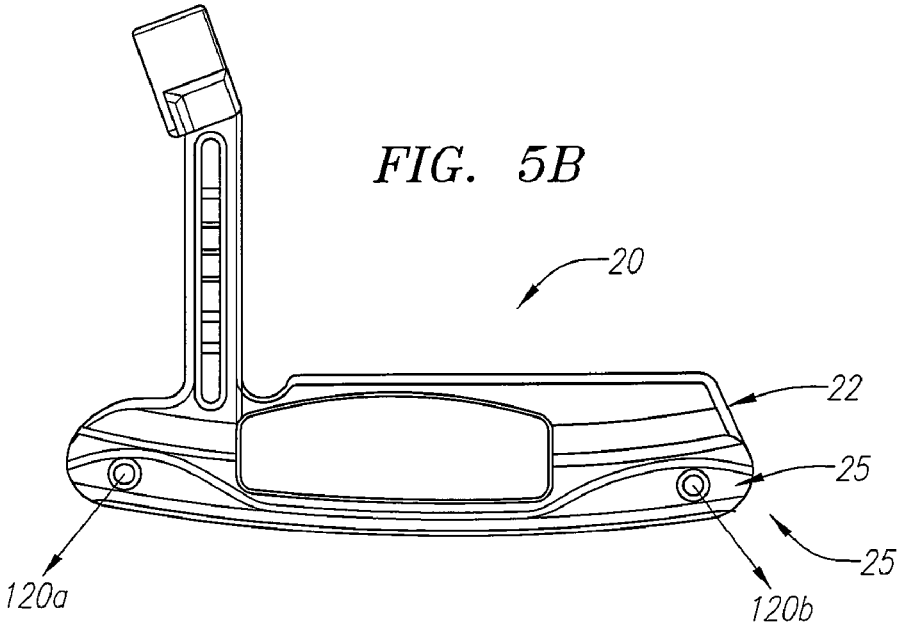

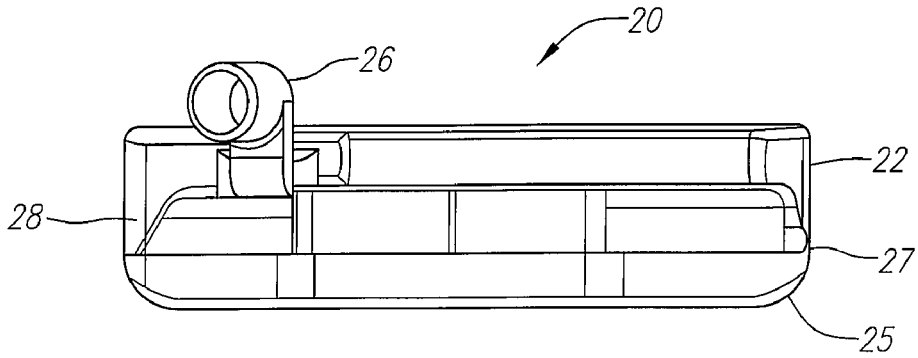
FIG. 6C
FIG. 6D
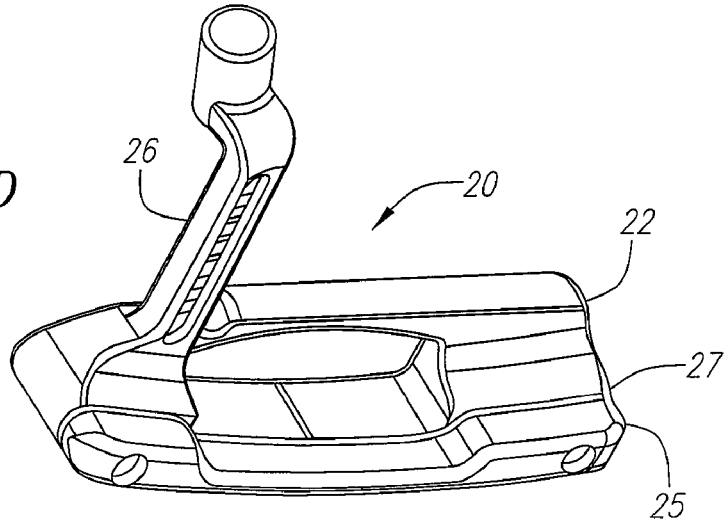
FIG. 6E
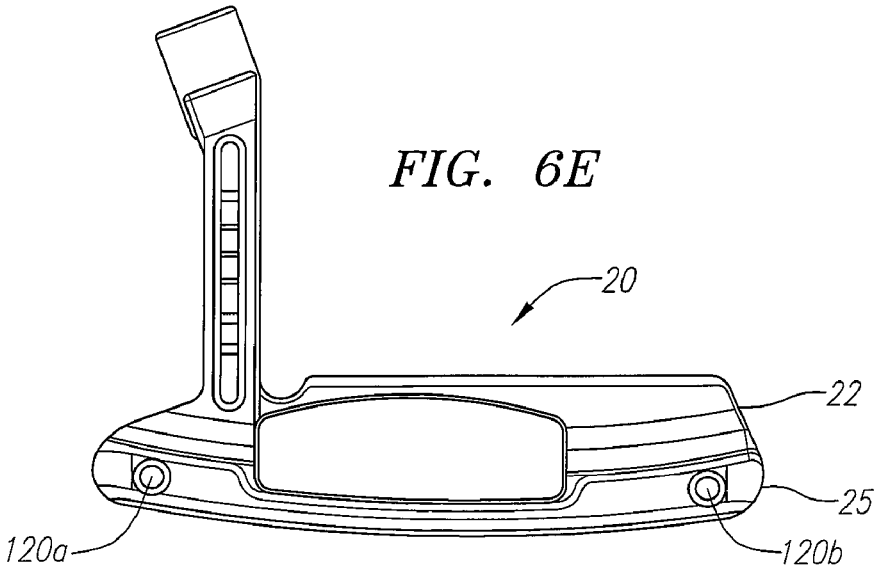

PUTTERHEAD WITH DUAL MILLED FACE PATTERN

CROSS REFERENCES TO RELATED APPLICATIONS

The Present Application is a continuation application of U.S. patent application Ser. No. 11/532,820, filed on Sep. 18, 2006 now U.S. Pat. No. 7,452,283.

STATEMENT REGARDING FEDERALLY SPONSORED RESEARCH OR DEVELOPMENT

Not Applicable

BACKGROUND OF THE INVENTION

1. Field of the Invention

The present invention relates to a putter-type golf club heads. More specifically, the present invention relates to a putter-type golf club head with a milled face.

2. Description of the Related Art

The milling of putter-heads is well-known in the golf industry. Computer Numerical Control (CNC) milling is also well-known in the golf industry.

U.S. Pat. No. 4,693,478 discloses a putter with a milled face.

U.S. Pat. No. 5,628,694 discloses a putter with two identical milled lateral faces.

U.S. Pat. No. 5,688,186 discloses a golf club face with different regions of grooves.

An example of the milling of putters is disclosed at www-.bettinardigolf.com, which discloses milled face putters.

U.S. Pat. Nos. 6,273,831, 6,336,869 and 6,478,690 all disclose a golf club head composed of multiple materials.

BRIEF SUMMARY OF THE INVENTION

One aspect of the present invention is a putter-type golf club head having a body. The body is composed of a metal material and has a striking face for impacting a golf ball. The striking face has a first milled pattern and a second milled pattern. The first milled pattern is located in a central area of the striking face and the second milled pattern encompasses the central area. The second milled pattern is different from the first milled pattern.

Preferably, the first milled pattern comprises a plurality of milled parallel horizontal lines and the second milled pattern comprises a plurality of milled parallel vertical lines.

Alternatively, the first milled pattern comprises a plurality of milled parallel vertical lines and the second milled pattern comprises a plurality of milled parallel horizontal lines.

Alternatively, the first milled pattern comprises a plurality of milled parallel horizontal lines and the second milled pattern comprises a plurality of milled curved lines.

Each of the plurality of milled parallel horizontal lines of the first milled pattern preferably has a depth ranging from 0.0001 inch to 0.010 inch.

Further, each of the plurality of milled parallel horizontal lines of the first milled pattern preferably has a depth greater than the depth of each of the plurality of milled parallel vertical lines of the second milled pattern.

The body is preferably composed of a stainless steel material. Alternatively, the body is composed of a titanium material.

The first milled pattern preferably has an area ranging from 0.25 square inch to 1.0 square inch, and the striking face has a total surface area ranging from 2.5 square inches to 5.0 square inches.

Another aspect of the present invention is a putter-type golf club head having a body composed of a metal material. The body has a sole section, a crown section, and a striking face for impacting a golf ball. The striking face has a central area with a first milled pattern and a periphery area with a second milled pattern. The second milled pattern is different from the first milled pattern. The striking face has a total surface area ranging from 2.5 square inches to 5.0 square inches. The central area ranges from 20% to 60% of the total surface area of the striking face.

Yet another aspect of the present invention is a putter-type golf club head having a body composed of a metal material with a striking face have dual milled patterns. The body has a sole section, a crown section, and a striking face for impacting a golf ball. The striking face has a central area with a first milled pattern and a periphery area with a second milled pattern. The second milled pattern is different from the first milled pattern. The first milled pattern has a first plurality of milled lines having a depth ranging from 0.0005 inch to 0.010 inch, and the second milled pattern has a second plurality of milled lines having a depth ranging from 0.0005 inch to 0.010 inch, The striking face has a total surface area ranging from 2.5 square inches to 5.0 square inches. The central area ranges from 20% to 60% of the total surface area of the striking face.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 5 is a bottom perspective view of a putter-head.

FIG. 5A is a top plan view of the putter-head of FIG. 5.

FIG. 5B is a rear view of the putter-head of FIG. 5.

FIG. 6C is a top plan view of the putter-head of FIG. 6.

FIG. 6D is a top perspective view of the putter-head of FIG. 6.

FIG. 6E is a rear view of the putter-head of FIG. 6.

DETAILED DESCRIPTION OF THE INVENTION

Figure 1:
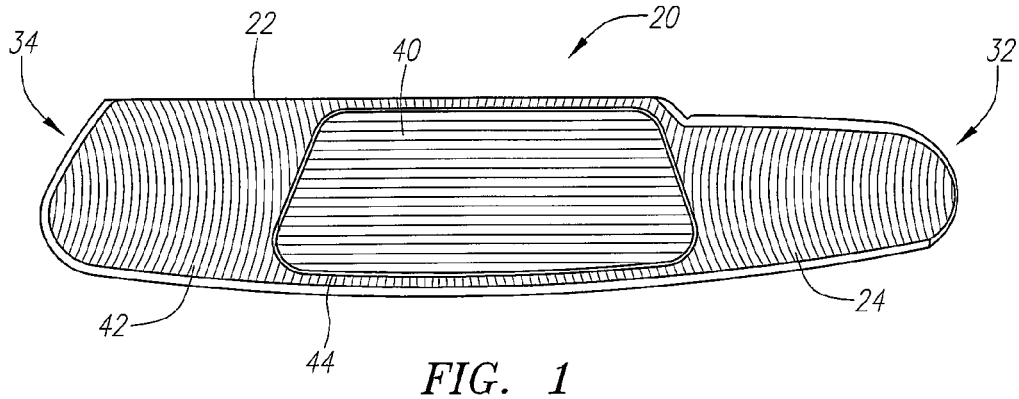
FIG. 1 is a front view of a putter-head.

As shown in the FIGS. 5-7G, a putter-type club head is generally designated 20. The putter-type club head 20 has a main body 22 that is preferably composed of a metal material, a weight body 25 composed of a high density material, and an isolation layer 27. A preferred metal for the main body 22 is stainless steel. Alternative materials for the main body 22 include titanium, titanium alloys, aluminum, aluminum alloys, magnesium, magnesium alloys, zinc, carbon steel, bronze, and the like. However, those skilled in the pertinent art will recognize that the main body 22 may be composed of other materials without departing from the scope and spirit of the present invention.

The main body 22 preferably weighs from 275 grams to 400 grams, more preferably from 300 grams to 350 grams, even more preferably from 315 grams to 335 grams and most preferably 328 grams.

The main body 22 preferably has a striking face 24, a crown section 28, a sole section 30 and an optionally a hosel 26 for attachment of a shaft thereto. A heel end 32 is opposite a toe end 34, and an aft-end 36 is opposite the striking face 24. The club head 20 also has a weight body 25 and an isolation layer 27 disposed between the weight body 25 and the main body 22.

Alternatively, the main body 22 is specifically weighted to provide a specific center of gravity for the golf club 20. The main body 22 preferably ranges from 200 grams to 250 grams. In an alternative embodiment, the main body 22 has a hollow interior, not shown, to lessen the weight of the main body 22. In yet another alternative embodiment, the hollow interior of the main body 22 is filled with a foam.

The weight body 25 is preferably composed of a tungsten alloy material, however, those skilled in the pertinent art will recognize that the weight body may be composed of any high density material. The preferred tungsten alloy material is 90% tungsten, 7% nickel and 3% iron. The density of the weight body 50 ranges from 10 grams per cubic centimeter ("g/cc") to 20 g/cc, and is most preferably 17 g/cc. The weight body 25 preferably weighs from 50 grams to 125 grams. Alternatively, the weight body is composed of a tungsten alloy such as described in U.S. Pat. No. 7,004,853 for a High Density Alloy For Improved Mass Properties In An Article, which is assigned to Callaway Golf Company of Carlsbad, Calif., and hereby incorporated by reference in its entirety.

The isolation layer 27 is preferably composed of a thermoplastic material, most preferably a thermoplastic polyurethane. The thickness of the isolation layer 27 varies from 0.020 inch to 0.100 inch, and is most preferably 0.035 inch. The function of the isolation layer 27 is to minimize the combination of the impact vibration frequency patterns of the main body 22 and the weight body 25. A more detailed explanation of the isolation layer 27 and the weight body 25 is provided in U.S. Pat. No. 6,095,931 for a Bi-Material Golf Club Head Having An Isolation Layer, which is assigned to Callaway Golf Company, and which is hereby incorporated by reference in its entirety.

The isolation layer 27 and the weight body 25 are preferably attached to the main body 22 by a plurality of screws that are threaded through holes in the club head 20. The golf club head 20 is preferably assembled by first positioning the isolation layer 27 between the weight body 25 and the main body 22. A first alignment pin 110*a* is inserted through the first main body alignment hole in the golf club head 20, a first isolation layer alignment hole and a first weight body alignment hole. A second alignment pin 110*b* is inserted through the second main body alignment hole in the golf club head 20, a second isolation layer alignment hole and a second weight body alignment hole, not shown. The placement of the alignment pins 110*a*-*b* ensures that the peripheral edges of the main body 34, the isolation layer 27 and the weight body 25 are properly alignment before permanent attachment of the isolation layer 27 and weight body 25 to the main body 22. To secure the components together, a first screw 120*a* is threaded through the holes and alignment pin 110*a*. A second screw 120*b* is threaded through the holes and alignment pin 110*b*. The screws 120*a* and 120*b* permanently fix the isolation layer 27 and the weight body 25 to the main body 22.

Figure 1A:
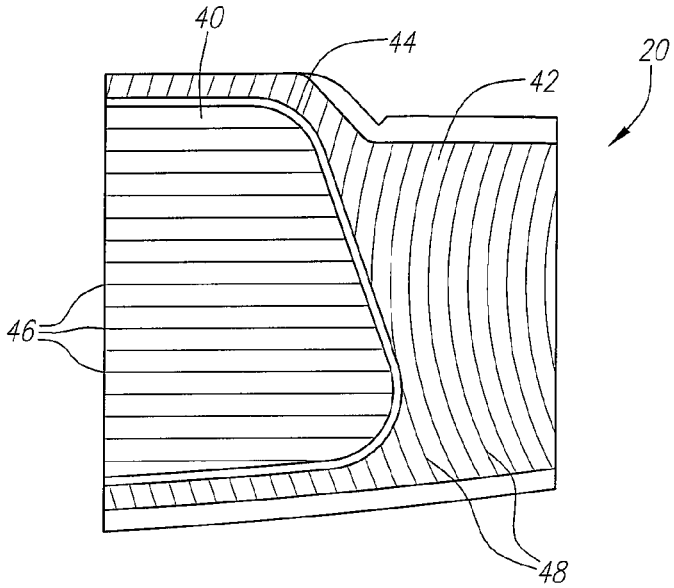
FIG. 1A is an enlarged partial view of the putter-head of FIG. 1.
Figure 2:
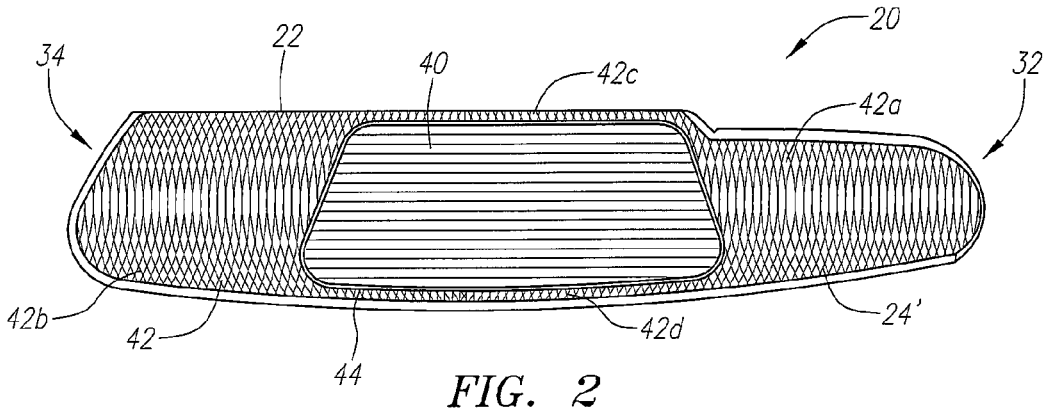
FIG. 2 is a front plan view of an alternative embodiment of a putter-head.

The striking face 24 preferably has a central area 40 and a periphery region 42. A perimeter 44 of the central area 40 generally defines a boundary between the central area 40 and the periphery region 42. The periphery region is preferably composed of a heel portion 42*a*, a toe portion 42*b*, a central crown portion 42*c* and a central sole portion 42*d*. As best shown in FIG. 1A, the central area 40 has a first milled pattern and the periphery region 42 has a second milled pattern which is different from the first milled pattern. The first milled pattern of the central area 40 has a first plurality of milled lines 46 having a depth ranging from 0.0001 inch to 0.010 inch, more preferably from 0.0003 inch to 0.001 inch, and most preferably about 0.0005 inch. The second milled pattern of the periphery region 42 has a second plurality of milled lines 48 having a depth ranging from 0.0001 inch to 0.010 inch, more preferably from 0.0003 inch to 0.001 inch, and most preferably about 0.0005 inch. Each of the first plurality of milled lines 46 and the second plurality of milled lines 48 is milled into the surface of the striking face 24, which is an integral part of the body 22. Each of the first plurality of milled lines 46 and the second plurality of milled lines 48 is preferably milled into the surface of the striking face 24 with a CNC milling apparatus.

In a preferred embodiment, the first plurality of milled lines 46 is a plurality of parallel horizontal lines 46, and the second plurality of milled lines 48 is a plurality of parallel curved vertical lines 48. Alternatively, the first plurality of milled lines 46 is a plurality of milled parallel vertical lines and the second plurality of milled lines 48 is a plurality of milled parallel horizontal lines. Alternatively, the first plurality of milled lines 46 is a plurality of milled parallel horizontal lines and the second plurality of milled lines 48 is a plurality of milled curved lines. Those skilled in the pertinent art will recognize that other combinations may be used for the first plurality of milled lines 46 and the second plurality of milled lines 48 without departing from the scope and spirit of the present invention.

Figure 3:
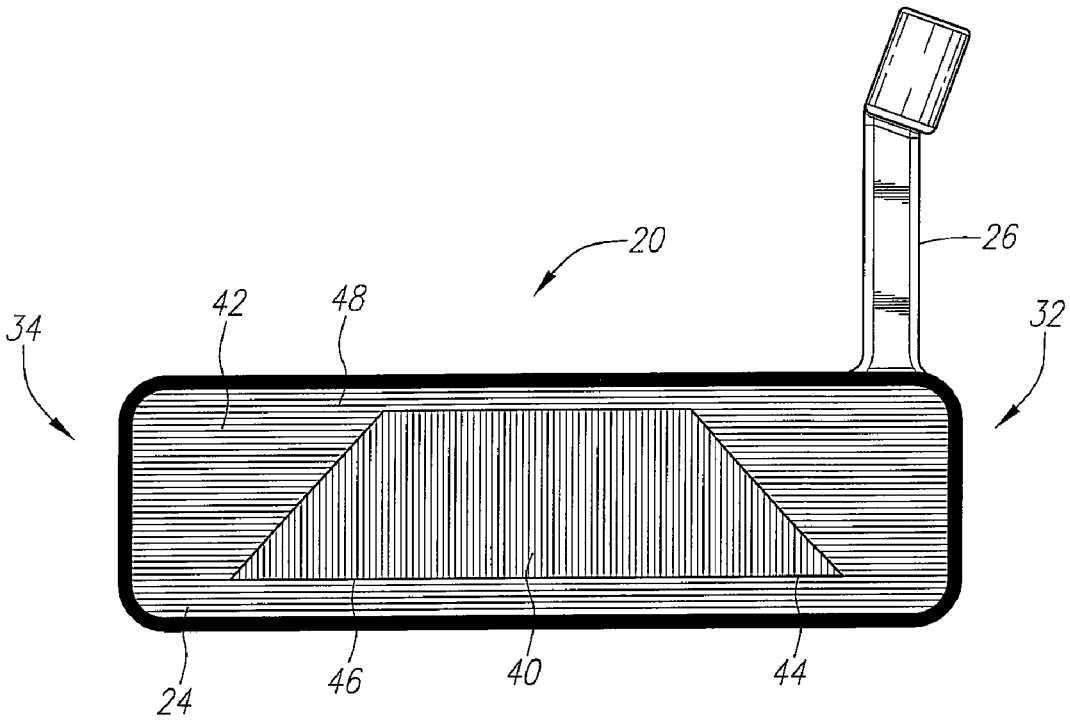
FIG. 3 is a front plan view of an alternative embodiment of a putter-head.
Figure 4:
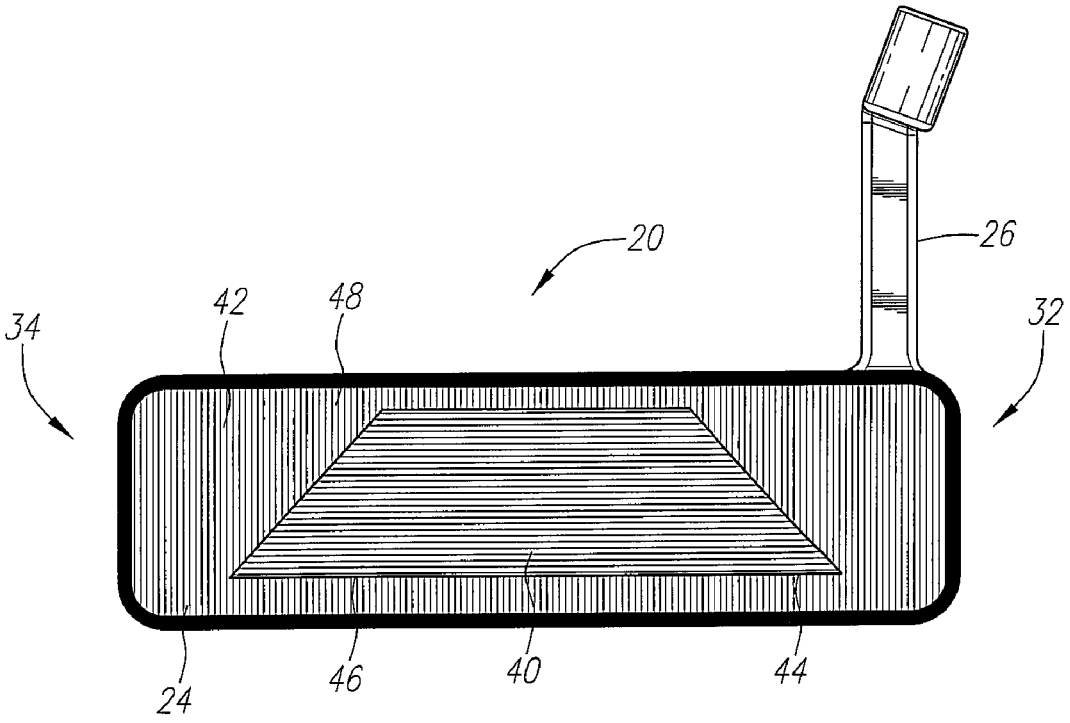
FIG. 4 is a front plan view of an alternative embodiment of a putter-head.
Figure 5C:
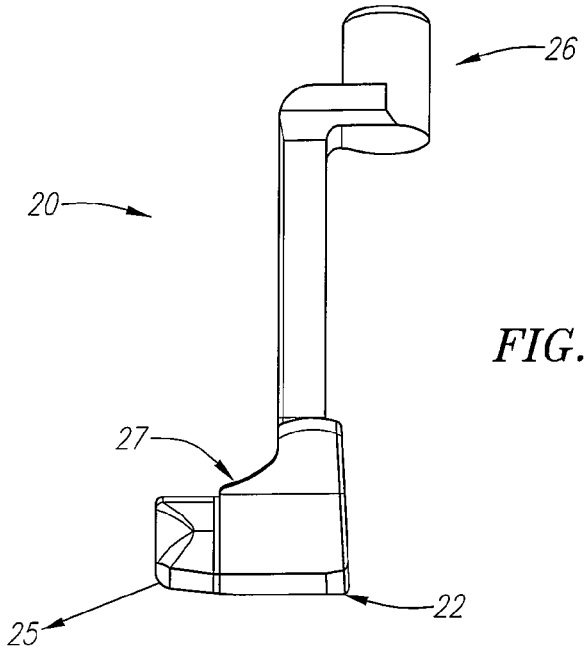
FIG. 5C is a toe-side view of the putter-head of FIG. 5.
Figure 5D:
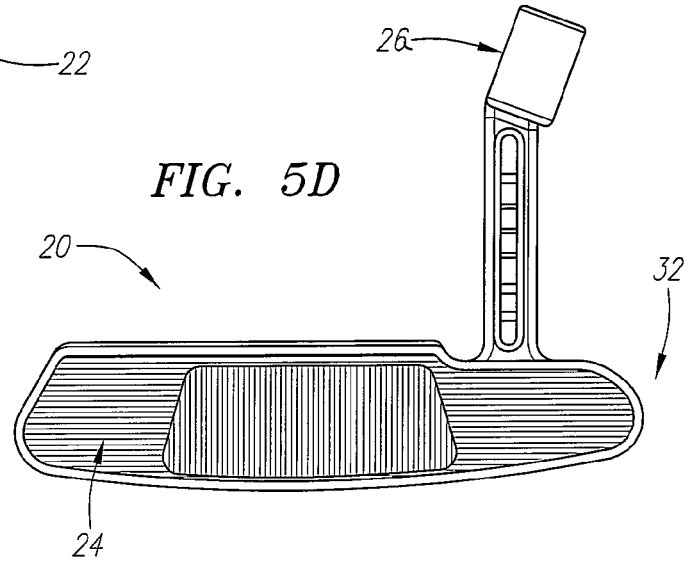
FIG. 5D is a front view of the putter-head of FIG. 5.
Figure 5E:
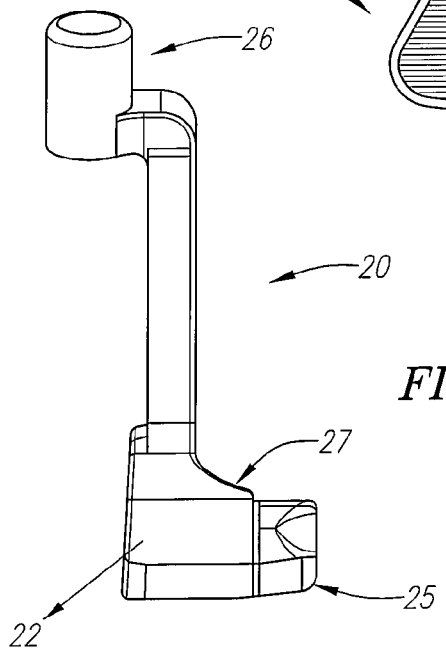
FIG. 5E is a heel side view of the putter-head FIG. 5.
Figure 5F:
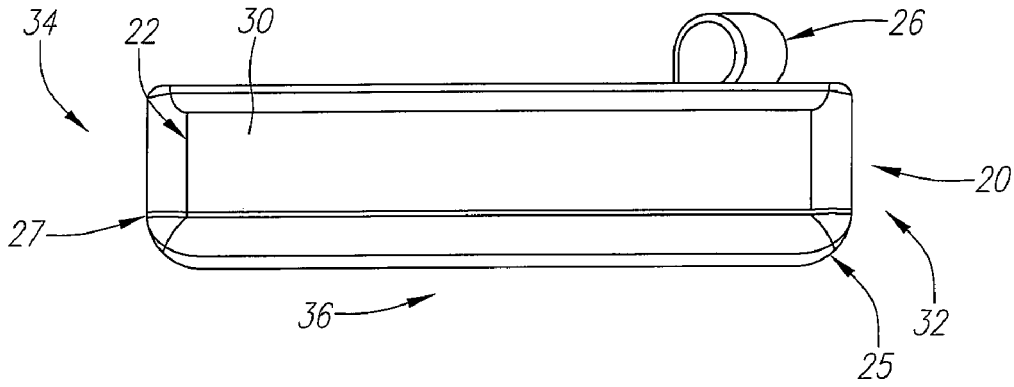
FIG. 5F is a bottom plan view of the putter-head of FIG. 5.
Figure 5G:
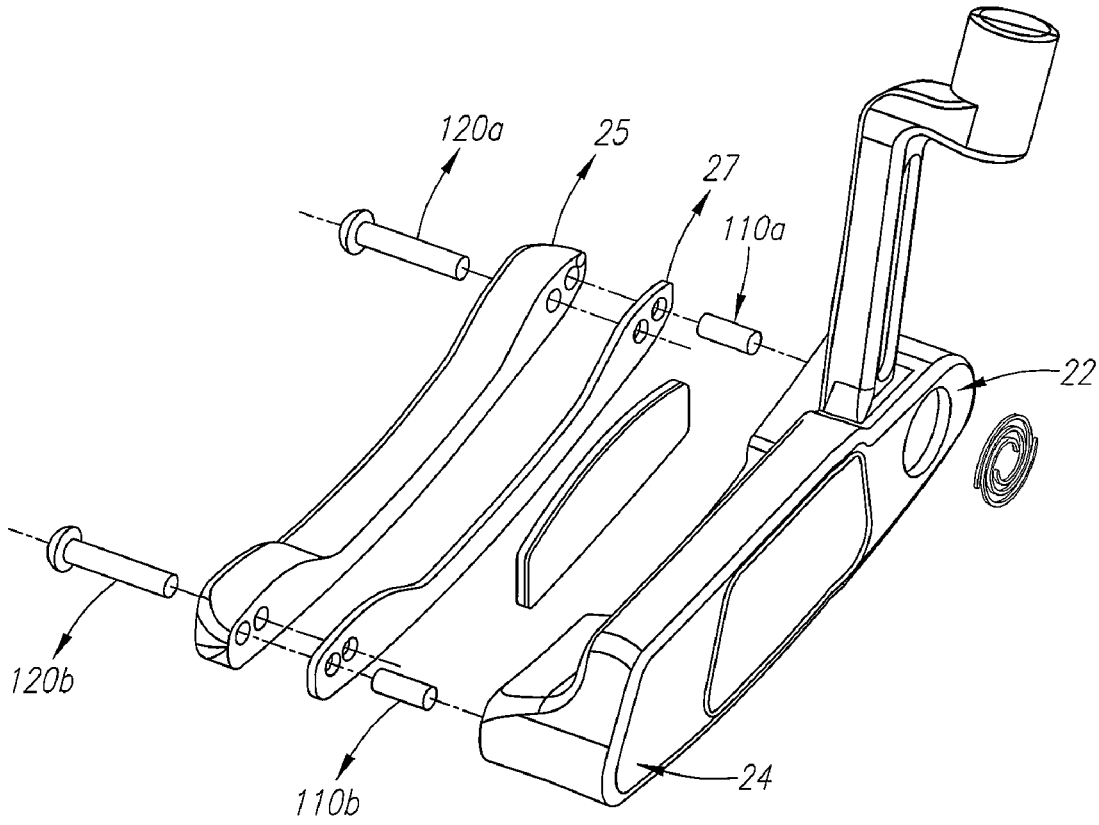
FIG. 5G is an exploded view of the putter-head of FIG. 5.
Figure 6:
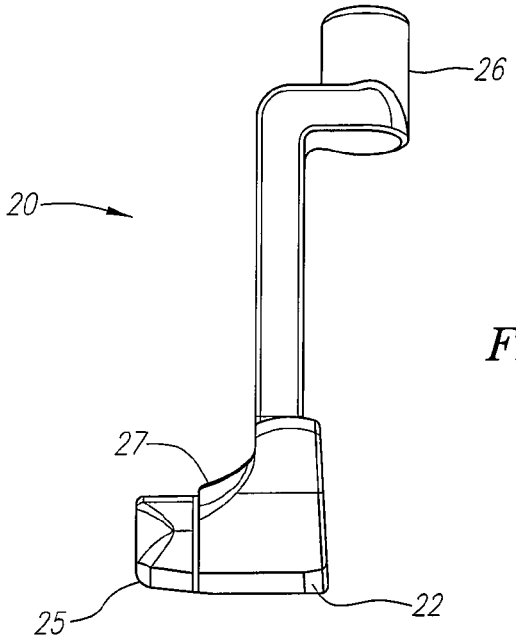
FIG. 6 is a toe side view of a putter-head.
Figure 6A:
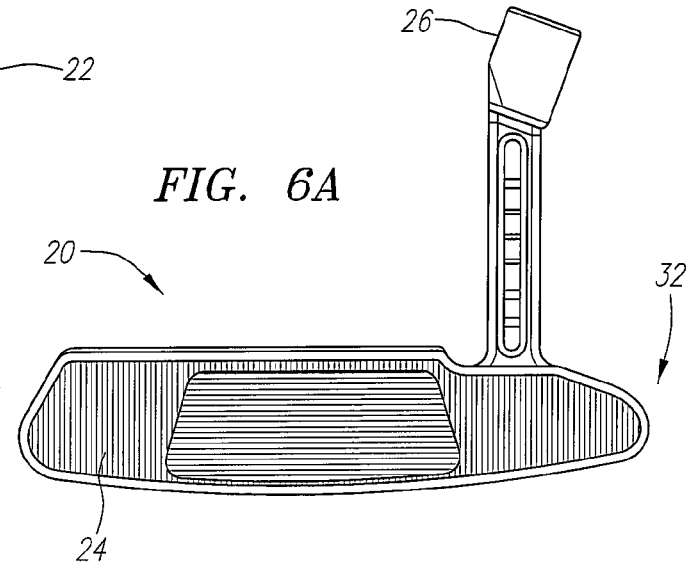
FIG. 6A is a front plan view of the putter-head of FIG. 6.
Figure 6B:
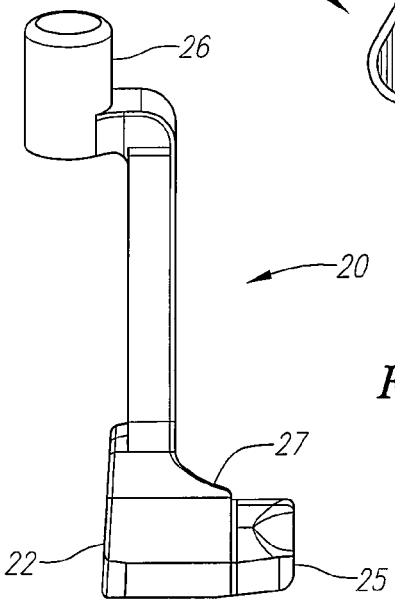
FIG. 6B is a heel-side view of the putter-head of FIG. 6.
Figure 6F:
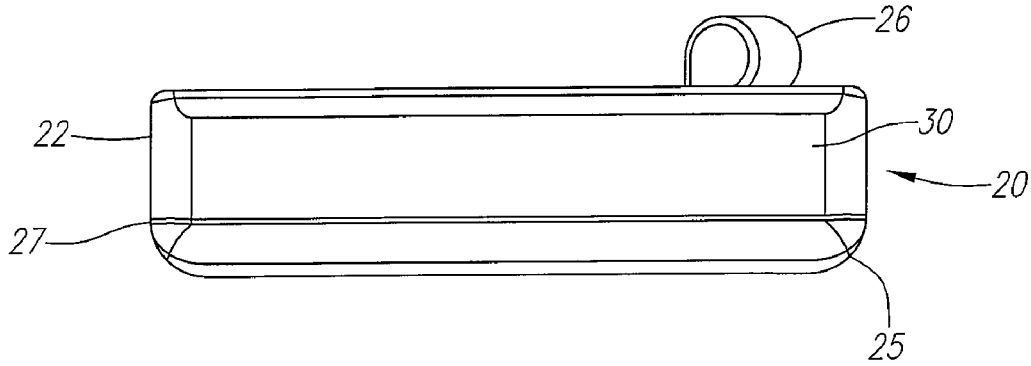
FIG. 6F is a bottom plan view of the putter-head of FIG. 6.
Figure 6G:
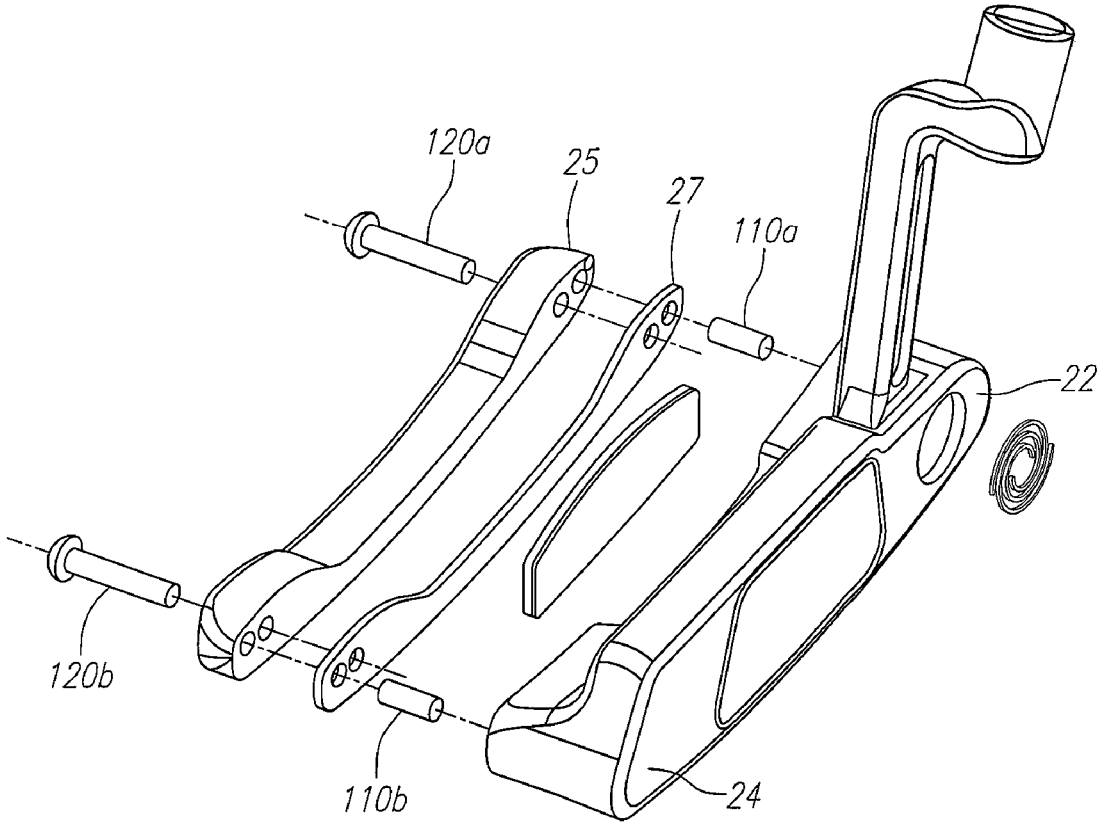
FIG. 6G is an exploded view of the putter-head of FIG. 6.
Figure 7:
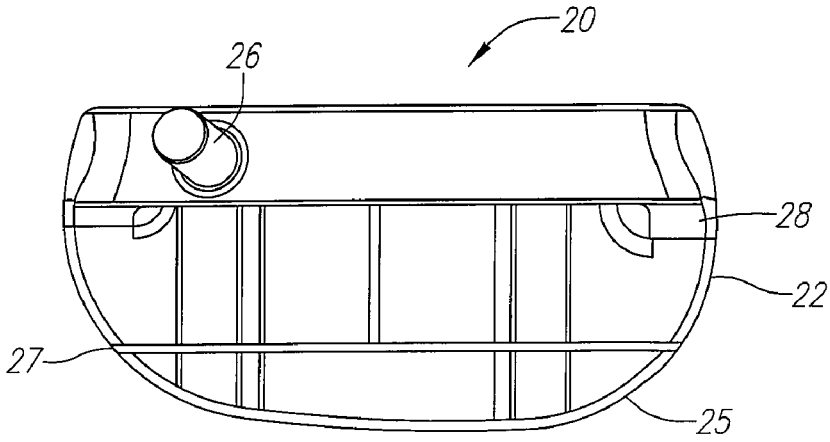
FIG. 7 is a top plan view of a putter-head.
Figure 7A:
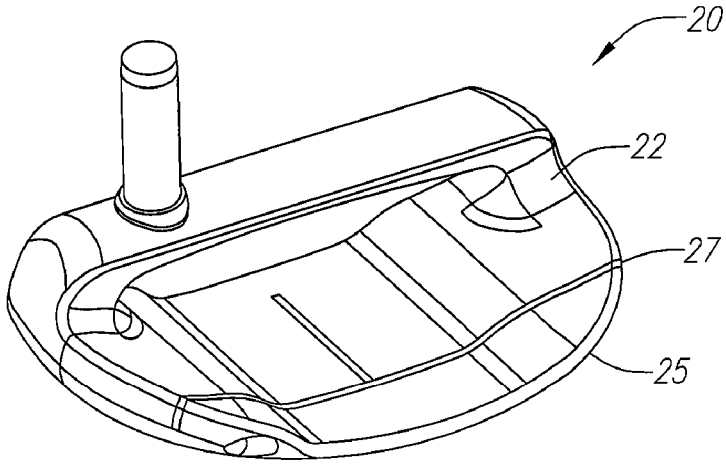
FIG. 7A is a top perspective view of the putter-head of FIG. 7.
Figure 7B:
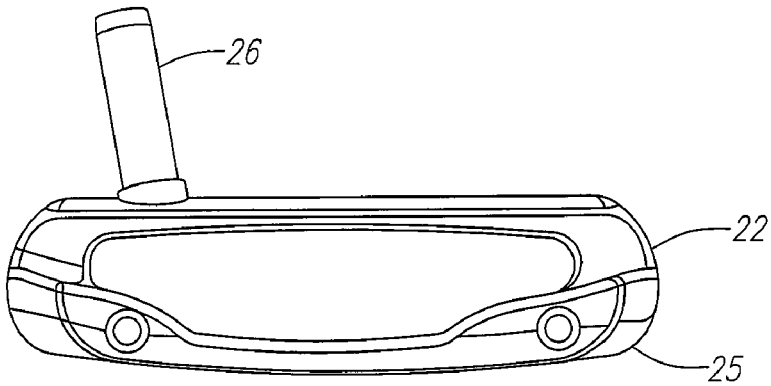
FIG. 7B is a rear view of the putter-head of FIG. 7.
Figure 7C:
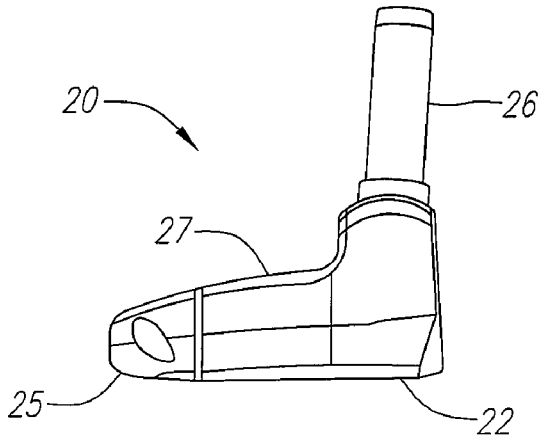
FIG. 7C is a toe-side view of the putter-head of FIG. 7.
Figure 7D:
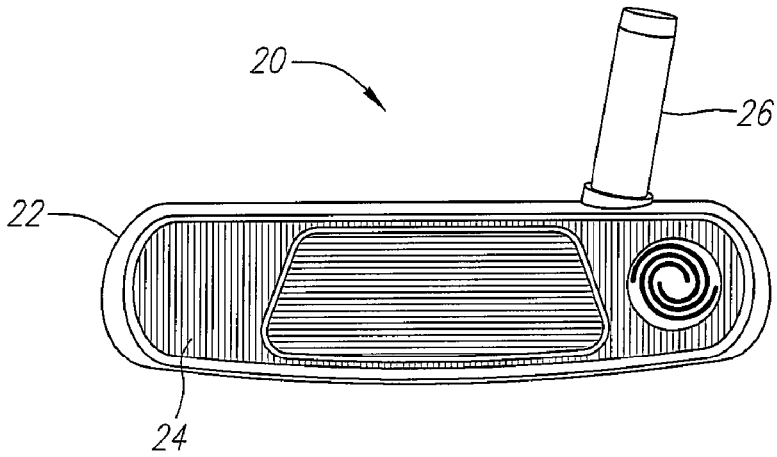
FIG. 7D is a front view of the putter-head of FIG. 7.
Figure 7E:
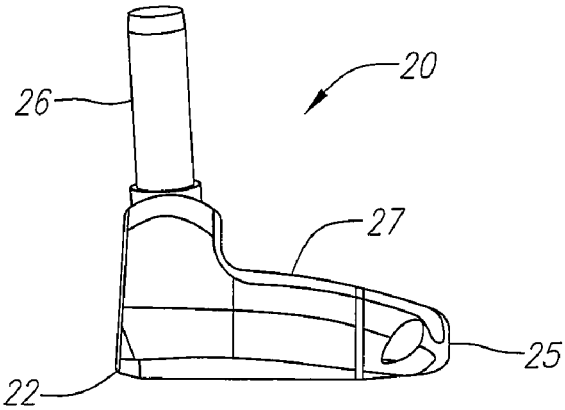
FIG. 7E is a heel side view of the putter-head of FIG. 7.
Figure 7F:
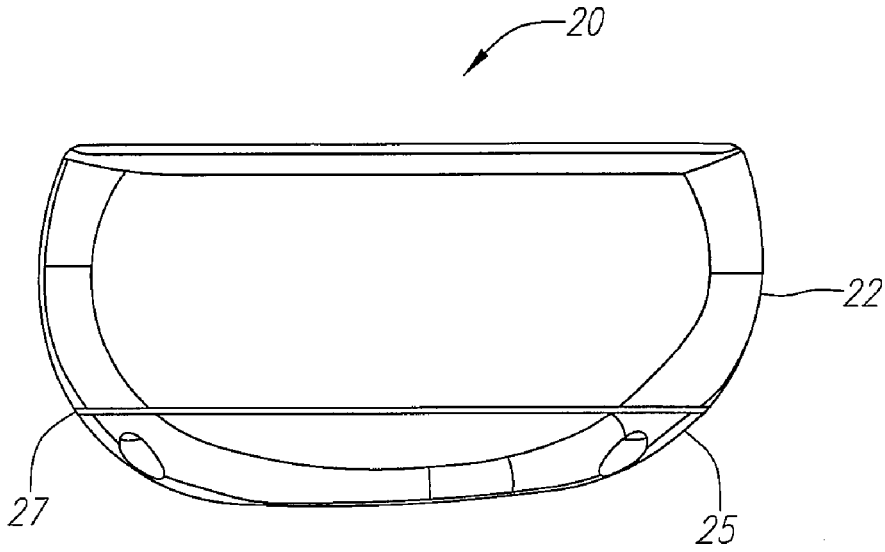
FIG. 7F is a bottom plan view of the putter-head of FIG. 7.
Figure 7G:
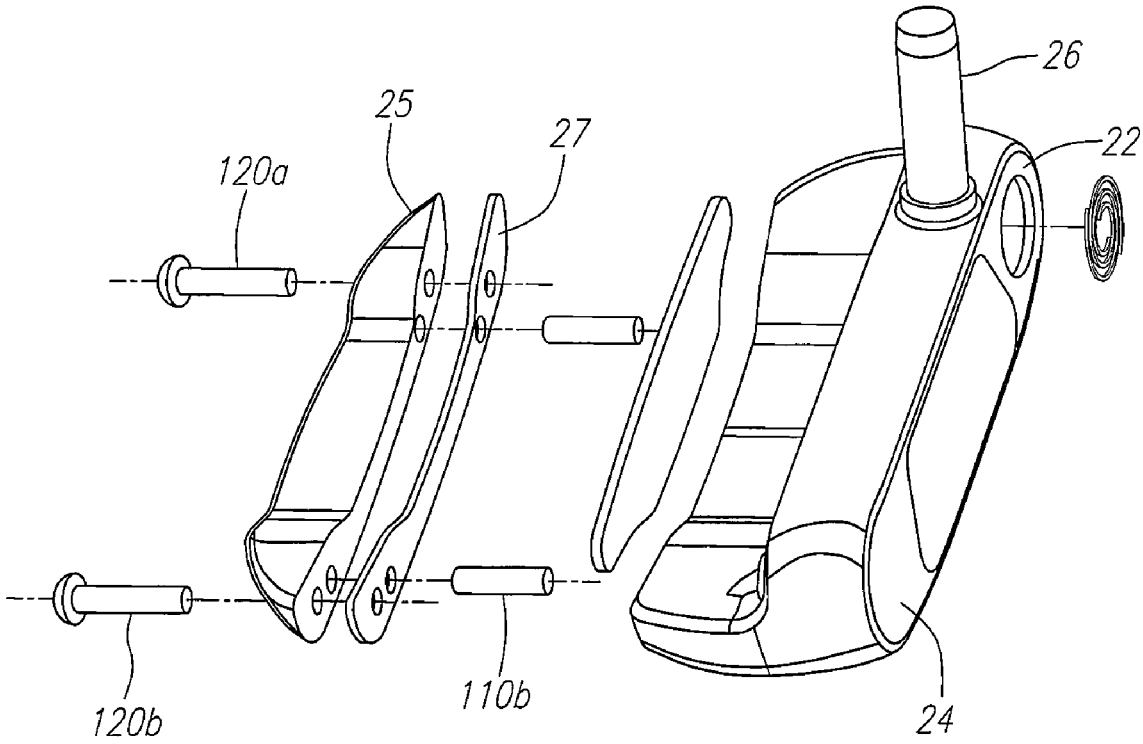
FIG. 7G is an exploded view of the putter-head of FIG. 7.

As shown in FIG. 3, each the first plurality of milled lines is vertical and each of the second plurality of milled lines 48 is horizontal, relative to the sole 30 of the putter-type club head 20. As shown in FIG. 4, each the first plurality of milled lines is horizontal and each of the second plurality of milled lines 48 is vertical, relative to the sole 30 of the putter-type club head 20.

The striking face 24 preferably has a total area that ranges from 2.5 square inches to 5.0 square inches. The central area 40 preferably has an area that ranges from 0.25 square inch to 2.5 square inches, and more preferably from 0.25 square inch to 1.0 square inch. The central area 40 preferably ranges from 20% to 60% of the total surface area of the striking face 24 with the entirety of the striking face 24 composed of the periphery region 42.

The putter-head 20 alternatively has an alignment means on a crown section 28. One such alignment means is disclosed in U.S. Pat. No. 6,471,600, entitled Putter Head, assigned to Callaway Golf Company, which pertinent parts are hereby incorporated by reference. Alternative alignment means are disclosed in U.S. Pat. No. 4,688,798, entitled Golf Club And Head Including Alignment Indicators, assigned to Callaway Golf Company, which pertinent parts are hereby incorporated by reference.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A putter-type golf club head comprising:

a main body composed of a metal material, the main body having a striking face for impacting a golf ball, the main body also having a toe end and a heel end opposite the toe end, the striking face having a first milled pattern and a second milled pattern, the first milled pattern located in a central area of the striking face and the second milled pattern encompassing the central area, the second milled pattern oriented differently from the first milled pattern, wherein the first milled pattern comprises a plurality of milled parallel horizontal lines extending generally in a heel end to toe end direction, and the second milled pattern comprises a plurality of milled parallel vertical lines, wherein each of the plurality of milled parallel horizontal lines of the first milled pattern has a depth greater than the depth of each of the plurality of milled parallel vertical lines of the second milled pattern.

2. The putter-type golf club head according to claim 1 wherein each of the plurality of milled parallel horizontal lines of the first milled pattern has a depth ranging from 0.0005 inch to 0.010 inch.

3. The putter-type golf club head according to claim 1 wherein the main body is composed of a stainless steel material.

4. The putter-type golf club head according to claim 1 wherein the main body is composed of a titanium material.

5. The putter-type golf club head according to claim 1 wherein the first milled pattern has an area ranging from 0.25 square inch to 1.0 square inch, and the striking face has a total surface area ranging from 2.5 square inches to 5.0 square inches.

6. The golf club head according to claim 1 wherein the main body is composed of carbon steel and weighs from 200 grams to 250 grams.

7. A golf club head comprising:

a main body composed of a metal material, the body having a sole section, a crown section, and a striking face for impacting a golf ball, the striking face having a central area with a first milled pattern and a periphery area with a second milled pattern, the second milled pattern different from the first milled pattern, the striking face having a total surface area ranging from 2.5 square inches to 5.0 square inches, the central area ranging from 20% to 60% of the total surface area of the striking face, wherein the first milled pattern comprises a plurality of milled parallel horizontal lines and the second milled pattern comprises a plurality of milled parallel vertical lines, wherein each of the plurality of milled parallel vertical lines extend generally in a sole section to crown section direction.

8. The golf club head according to claim 7 wherein the central area ranges from 30% to 45% of the total surface area of the striking face.

9. A golf club head comprising:

a main body composed of a metal material, the main body having a heel end, a toe end, a sole section, a crown section and a striking face for impacting a golf ball, the striking face having a central area with a first milled pattern and a periphery area with a second milled pattern, the second milled pattern different from the first milled pattern, the first milled pattern comprising a first plurality of milled lines having a depth ranging from 0.0005 inch to 0.010 inch, the second milled pattern comprising a second plurality of milled lines having a depth ranging from 0.0005 inch to 0.010 inch, the periphery area encompassing the central area, the striking face having a total surface area ranging from 2.5 square inches to 5.0 square inches, the central area ranging from 20% to 60% of the total surface area of the striking face, wherein the first milled pattern comprises a plurality of milled parallel horizontal lines extending generally in a heel end to toe end direction, and the second milled pattern comprises a plurality of milled curved lines; and a weight body attached to the main body.

10. The golf club head according to claim 9 wherein the crown section further comprises an alignment device, the alignment device selected from the group consisting of a plurality of aligned circles, a plurality of aligned chevrons and a plurality of parallel lines extending rearward from the striking face.

11. The golf club head according to claim 9 wherein the main body is composed of a metal material selected form the group consisting of stainless steel, titanium, titanium alloy, aluminum alloy, aluminum, magnesium and magnesium alloy.

12. The golf club head according to claim 9 wherein the weight body is composed of a tungsten alloy and weighs from 50 grams to 125 grams.

* * * * *